US007392912B2

(12) United States Patent
Zandt

(10) Patent No.: US 7,392,912 B2
(45) Date of Patent: Jul. 1, 2008

(54) MERCHANDISING DISPLAY SYSTEM AND METHOD OF USE

(76) Inventor: Jim C. Zandt, 1769 San Luis Dr., San Luis Obispo, CA (US) 93401

( * ) Notice: Subject to any disclaimer, the term of this patent is extended or adjusted under 35 U.S.C. 154(b) by 296 days.

(21) Appl. No.: 11/205,536

(22) Filed: Aug. 16, 2005

(65) Prior Publication Data

US 2007/0039907 A1 Feb. 22, 2007

(51) Int. Cl.
*A47F 5/08* (2006.01)

(52) U.S. Cl. ..... 211/94.01; 211/57.1

(58) Field of Classification Search ..... 211/94.01, 211/57.1, 59.1, 85.1; 248/220.21, 220.43, 248/223.41, 224.51, 224.61, 224.7
See application file for complete search history.

(56) References Cited

U.S. PATENT DOCUMENTS

| | | | | |
|---|---|---|---|---|
| 3,200,960 | A | 8/1965 | Banse | 211/59 |
| 4,094,415 | A | 6/1978 | Larson | 211/57.1 |
| 4,509,648 | A | 4/1985 | Govang et al. | 211/70.6 |
| 4,826,022 | A | 5/1989 | Duarte | 211/59.7 |
| 5,109,993 | A | 5/1992 | Hutchison | 211/87 |
| 5,154,304 | A | 10/1992 | McAuley | 211/59.1 |
| 5,316,252 | A * | 5/1994 | Charnow et al. | 248/224.51 |
| 5,484,067 | A | 1/1996 | Sothman | 211/87 |
| 5,595,309 | A * | 1/1997 | Bauer et al. | 211/59.1 |
| 5,927,517 | A | 7/1999 | Lipman et al. | 221/59.1 |
| 6,068,135 | A * | 5/2000 | Holztrager | 211/4 |
| 6,070,747 | A | 6/2000 | Shea | 211/87.01 |
| 6,481,584 | B1 | 11/2002 | Cantley | 211/87.01 |
| 6,491,172 | B2 * | 12/2002 | Chance et al. | 211/87.01 |
| 6,536,613 | B2 | 3/2003 | Shea | 211/87.01 |
| 6,561,474 | B1 | 5/2003 | Walter et al. | 248/220.22 |
| 6,575,314 | B2 | 6/2003 | Lung et al. | 211/163 |
| 6,644,483 | B1 | 11/2003 | MIng-Te-Lai | 211/87.01 |
| 6,675,978 | B2 * | 1/2004 | Shea | 211/59.1 |
| 2005/0072746 | A1 * | 4/2005 | O'Brien | 211/59.1 |

* cited by examiner

*Primary Examiner*—Jennifer E. Novosad
(74) *Attorney, Agent, or Firm*—Philip A. Steiner, Esq.

(57) ABSTRACT

A merchandising system which comprises a display panel dimensioned to cover at least a portion of a slot wall. The display panel includes a forward facing surface having coupled thereto a plurality of receptacles, each of the plurality of receptacles being adapted to receive a support arm of sufficient structural integrity to maintain at least one item of merchandise suspended therefrom; a top edge having coupled to at least a portion thereof, at least one bracket dimensioned to engage a slot provided in the slot wall and configured to maintain the display panel in a generally parallel orientation to the slot wall when the at least one item of merchandise is displayed thereon; and a plurality of support arms, each of the plurality of support arms being adapted to couple to at least one of the plurality of receptacles and descriptive signage affixed to the forward facing surface.

24 Claims, 6 Drawing Sheets

MERCHANDISING DISPLAY SYSTEM AND METHOD OF USE

CROSS-REFERENCE TO RELATED APPLICATIONS

Not applicable

FEDERALLY SPONSORED RESEARCH AND DEVELOPMENT

Not Applicable

REFERENCE TO A MICROFICHE APPENDIX

Not Applicable

FIELD OF INVENTION

The present invention relates generally to a merchandising display system, and more specifically to a lightweight display panel which is configured to interface with slot board display walls. The invention provides a sub display board which allows rapid repositioning and maintenance of stock.

BACKGROUND

Slotted display walls, also known as slat walls, have become popular in many retail environments. The slot walls allow for significant flexibility in organization and merchandising of items of various shapes and sizes. In addition, slot board displays are generally more aesthetically appealing than the previous pegboard systems and offer an advantage of continuous rather than incremental horizontal merchandise position adjustment. However, slot boards employed in the relevant art still generally requires labor intensive repositioning of individual supports to accommodate a particular grouping of merchandise.

In general, most of the improvements in the relevant art, have been directed toward strengthening the slot board or preventing dislodging of a support arm when a consumer removes an item of merchandise. For smaller retail items, repositioning of support arms, restocking and movement of merchandise can be rather time consuming, labor intensive and result in inefficient space utilization.

Therefore, an arrangement which allows a merchandiser to use slot boards but does not require significant individual repositioning of merchandise and support arms is highly desirable, particularly in circumstances where slot wall space is devoted to the merchandising of groupings of related or complementary items.

SUMMARY

In a first embodiment of the invention, a merchandising system is provided which comprises a display panel dimensioned to cover at least a portion of a slot wall. The display board includes coupling means for coupling a plurality of support arms to a forward facing surface of the display panel, interfacing means for interfacing the display panel to the slot wall, and a plurality of support arms. Each of the plurality of support arms are adapted to couple to the display panel using the coupling means and maintain a plurality of related or complementary merchandise items which are suspended therefrom. The merchandising system forms an easily maintainable sub panel means when the plurality of related or complementary merchandise items are suspended from the plurality of support arms and the display panel is interfaced to the slot wall using the interface means.

In a related embodiment of the invention, the display panel comprises a lightweight polymeric construction. In another related embodiment of the invention, the coupling means comprises a plurality of raised frames affixed to the forward facing surface at regular intervals. In yet another related embodiment of the invention, the interfacing means comprises at least one bracket coupled to at least a portion of a top edge of the display panel.

In a second embodiment of the invention, a merchandising system is provided which comprises a display panel dimensioned to cover at least a portion of a slot wall.

The display panel included a forward facing surface having coupled thereto a plurality of receptacles, each of the plurality of receptacles being adapted to receive a support arm of sufficient structural integrity to maintain at least one item of merchandise suspended therefrom; a top edge having coupled to at least a portion thereof, at least one bracket dimensioned to engage a slot provided in the slot wall and configured to maintain the display panel in a generally parallel orientation to the slot wall when the at least one item of merchandise is displayed thereon; and a plurality of support arms, each of the plurality of support arms being adapted to couple to at least one of the plurality of receptacles.

In a related embodiment of the invention, the display panel comprises a lightweight polymeric construction. In another related embodiment of the invention, the at least one bracket comprises a rearward facing element coupled to the at least a portion of the top edge in a generally perpendicular orientation to the forward facing surface, such that one dimension of the rearward facing element fits into the slot and engages an interior surface of the slot wall. In another related embodiment of the invention, the support arm is adapted to engage at least one of the plurality of receptacles at an acute angle to the forward facing surface. In another related embodiment of the invention, the support arm is adapted to engage at least one of the plurality of receptacles at generally a right angle to the forward facing surface.

In a further related embodiment of the invention, the plurality of receptacles comprises a plurality of raised frames affixed to the forward facing surface. In yet another related embodiment of the invention, the raised frames are affixed to the forward facing surface at regular intervals.

In another related embodiment of the invention, the support arm comprises a longitudinal element, a connector disposed at one end of the longitudinal element and adapted to securely couple the support arm to at least one of the plurality of receptacles; and a hook at an opposite end from the connector and adapted to maintain the at least one item of merchandise on the support arm under generally static conditions. In another related embodiment of the invention, the at least one bracket slidably engages the slot or tangentially engages the slot.

In yet another related embodiment of the invention, indicia of the related merchandise is affixed to the display panel. The indicia may be in the form of an adhesive label which is applied to the forward facing surface of the display panel.

In a third embodiment of the invention, a method of merchandising items is described which comprises; obtaining a display panel dimensioned to cover at least a portion of a slot wall, the display panel being adapted to interface with a slot board and including means for receiving a plurality of support arms, coupling a plurality of support arms to the display panel in an arrangement such that merchandisable items may be disposed on the plurality of support arms without causing visual obstruction in a field of view generally perpendicular to the forward facing surface, placing generally complementary subsets of the merchandisable items onto the plurality of support arms such that the display panel forms an easily repositionable grouping of complementary merchandisable items, and mounting the display panel having the placed groupings of complementary merchandisable items onto the slot wall.

In a related embodiment of the invention, the placed groupings are optimized to meet sales demand. In another related embodiment of the invention, the method for mounting comprises either slidably disposing or tangentially disposing the display panel in a slot associated with the slot wall.

In a fourth embodiment of the invention, a method of merchandising items which incorporates a display panel dimensioned to cover at least a portion of a slot wall, the display panel including a forward facing surface having a plurality of receptacles for receiving a plurality of support arms, a top edge having coupled to at least a portion thereof, at least one bracket dimensioned to engage a slot provided in the slot wall and configured to maintain the display panel in a generally parallel orientation to the slot wall when the at least one item of merchandise is displayed thereon and a plurality of support arms adapted to couple to at least one of the plurality of receptacles.

The above described method of merchandising items comprises coupling at least a portion of the plurality of support arms to at least a portion of the plurality of receptacles in an arrangement such that merchandisable items may be disposed on each of the plurality of support arms without causing visual obstruction in a field of view generally perpendicular to the forward facing surface, placing generally complementary subsets of the merchandisable items onto the plurality of support arms such that the display panel forms an easily repositionable grouping of complementary merchandisable items, and mounting the display panel having the placed grouping of complementary merchandisable items onto the slot wall.

In a related embodiment of the invention, the placed groupings are optimized to meet sales demand. In another related embodiment of the invention, the mounting of the display panel comprises sliding the at least one bracket into the slot and moving the display panel laterally. In a final related embodiment of the invention, the mounting of the display panel comprises tilting the display panel at an angle to slot wall, inserting the at least one bracket into the slot and allowing the display panel to pivot to a generally parallel orientation to the slot wall.

In fifth embodiment of the invention, the merchandising display system comprises a display panel dimensioned to cover at least a portion of a slot wall includes a forward facing surface having coupled thereto a plurality of receptacles, each of the plurality of receptacles being adapted to receive a support arm of sufficient structural integrity to maintain at least one item of merchandise suspended therefrom.

The top edge of the display panel has coupled to at least a portion thereof, at least one bracket dimensioned to engage a slot provided in said slot wall and configured to maintain said display panel in a generally parallel orientation to said slot wall when the at least one item of merchandise is displayed thereon; a plurality of support arms, each of the plurality of support arms being adapted to couple to at least one of the plurality of receptacles; at least one item of merchandise; and written instructions for at least displaying the at least one item of merchandise from the display panel.

In a related embodiment of the invention, the display panel having the at least one bracket coupled thereto, the plurality of support arms, the at least one item of merchandise and the written instructions comprise a kit arranged for distribution to at least one merchandiser.

In other related embodiments of the invention, the kit is distributed to the least one merchandiser either assembled or unassembled.

BRIEF DESCRIPTION OF DRAWINGS

The invention provides a sub panel for use with commonly available slot walls. The features and advantages of the invention will become apparent from the following detailed description when considered in conjunction with the accompanying drawings. Where possible, the same reference numerals and characters are used to denote like features, elements, components or portions of the invention.

Optional components are generally shown in dashed lines. It is intended that changes and modifications can be made to the described embodiment without departing from the true scope and spirit of the subject invention as defined in the claims.

DETAILED DESCRIPTION

The invention addresses the limitations of merchandising using slot walls and provides an easily configured sub panel which allows direct replacement of merchandising items without having to individually reposition support arms on a slot wall. This simplifies displaying of merchandise and stock re-ordering and for merchandisers and allows a distributor to standardized displays in multiple locations.

Figure 1:
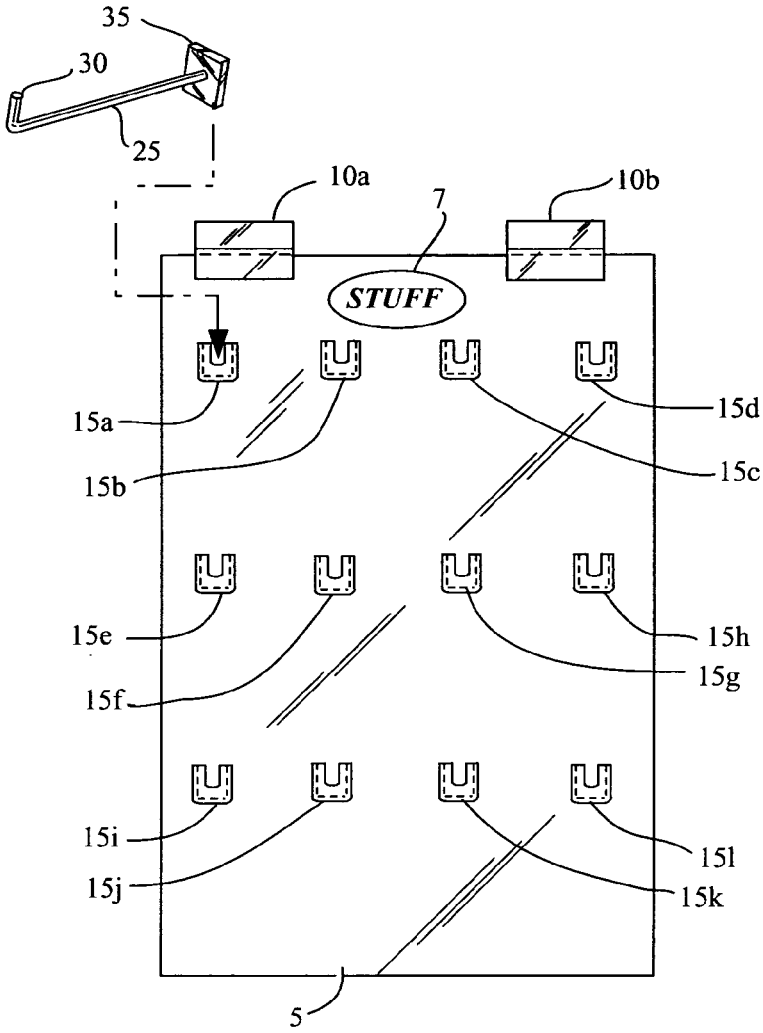
FIG. 1—depicts a frontal view of the invention.

Referring to FIG. 1, a frontal view of the invention is depicted. The invention comprises a generally planar display board 5, one or more brackets 10*a*, 10*b* affixed to the top edge of the display board 5, a plurality of raised frames 15*a*-15*l* for attaching one or more support arms 25 to the display board 5 and the one or more support arms 25. In an embodiment of the invention, the raised frames 15*a*-15*l* are attached adhesively to the front surface of the display board 5 at uniformly spaced horizontal and vertical intervals.

In an embodiment of the invention, the display board 5, raised frames 15*a*-15*l*, brackets 10*a*, 10*b* and support arm(s) 25 are all constructed from an acrylic polymeric material, for example Plexiglas (TM). The acrylic polymer material may be transparent, opaque or colored to meet specific merchandising plans. The number of raised frames 15*a*-15*l* may be varied as well to accommodate different packaging dimensions of the suspended merchandise. One skilled in the art will appreciate that the actual construction materials and color selection may be changed to suit a particular environmental or business need without departing from the basic invention.

Figure 2:
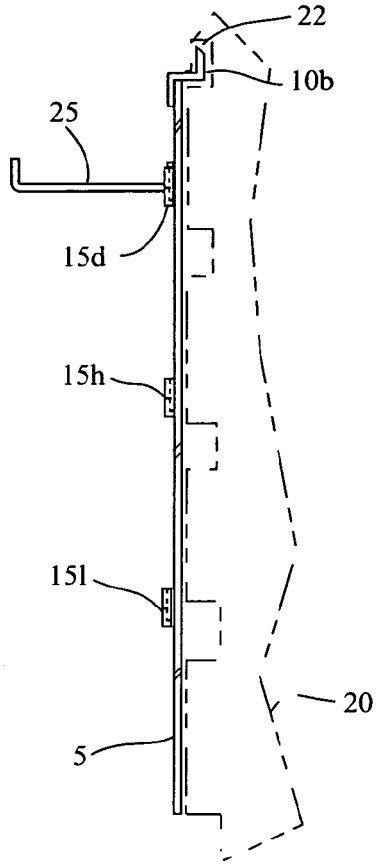
FIG. 2—depicts a side view of the invention.

The brackets 10*a*, 10*b* are formed into an elbow to allow simple insertion into a slot 22 (FIG. 2) of a slot board 20 (FIG. 2). Either a modified "L" or "T" shape may be used to fit into a slot 22 (FIG. 2) of a slot board 20 (FIG. 2). In an embodiment of the invention, the brackets 10*a*, 10*b* are affixed to the top edge of the display board 5 using an adhesive.

Fasteners may be used as well to affix the brackets 10*a*, 10*b* to the display board 5. If only lightweight merchandise is to be displayed, a single, laterally centered bracket 10*a* may suffice.

One or more rod shaped support arms 25 are provided with connectors 35 which slidably fit into the raised frames 15*a*-15*l* in a cantilever arrangement. A hook 30 is provided at the end of the support arm 25 opposite from the connector 35. In an embodiment of the invention, the length of the support arm(s) 25 may be varied to accommodate a wide range of merchandise and sales demand. For example, a slower selling item of merchandise may be placed on a shorter support arm 25 while another more rapid selling item of merchandise may be placed on a longer support arm 25. In another embodiment of the invention, signage 7 (i.e., "STUFF,") is affixed to the front face of the display panel 5. The signage 7 may be a simple adhesive backed type label.

The signage 7 is intended to provide a visual reference of what merchandise is available on the display board 5, thus simplifying the location and/or identification of merchandise for both a customer and the merchandiser. The signage 7 is typically affixed to the display board in the space between the brackets 10*a*, 10*b* and first row of raised frames 15*a*, 15*b*, 15*c*, 15*d*.

Referring to FIG. 2, a side view of the invention is depicted. In an embodiment of the invention, a portion of the bracket 10*b* engages an interior surface of the channel forming the slot 22. The second bracket 10*a* is not shown, but engages the same slot 22 in parallel to the bracket 10*b* depicted.

The display board 5 is shown as a thin rectangular sheet of acrylic material. The dimensions of the display board 5 are not critical and may be constructed in any convenient shape or size.

The visible raised frames 15*d*, 15*h*, 15*l* are shown as having a relatively low profile to maximize the merchandise storage capacity of the display board 5. More rugged arrangements are envisioned as well which will allow the support arm(s) 25 to maintain heavier merchandise.

Figure 3:
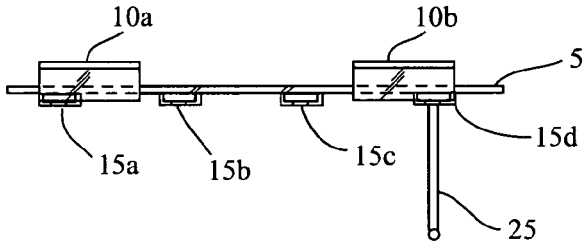
FIG. 3—depicts a top view of the invention.

Referring to FIG. 3, a top view of the invention is depicted. In an exemplary embodiment of the invention, a pair of brackets 10*a*, 10*b* is affixed to the top edge of the display board 5 using an appropriate solvent based adhesive. The dimensions of the brackets 10*a*, 10*b* are determined by the cumulative weight to be supported by the brackets 10*a*, 10*b*.

In most commonly encountered merchandising environments, the dimensions of the brackets 10*a*, 10*b* are not critical. When heavy loads are anticipated, the bracket 10*a*, 10*b* dimensions will be determined by either the shear strength of the acrylic material and/or the weld strength of the adhesive used to join the brackets 10*a*, 10*b* to the display panel 5.

In an embodiment of the invention, a row of raised frames 15*a*, 15*b*, 15*c*, 15*d* is affixed to the forward face of the display panel 5 using an appropriate solvent based adhesive. The raised frames 15*a*, 15*b*, 15*c*, 15*d* form receptacles for receiving the support arm(s) 25. In this depicted embodiment of the invention, the raised frames 15*a*, 15*b*, 15*c*, 15*d* are generally rectangular shaped members having a generally rectangular hollow interior, a rectangular slot at the top and a "U" shaped channel on their forward face which intersects the slot along a vertical centerline of the raised frames 15*a*, 15*b*, 15*c*, 15*d*. The rectangular slot is dimensioned to receive the generally rectangular connector 35 (FIG. 4) affixed to the support arm 25 (FIG. 4); the "U" shaped channel is dimensioned to receive the rod portion of the support arm 25 (FIG. 4).

Figure 4:
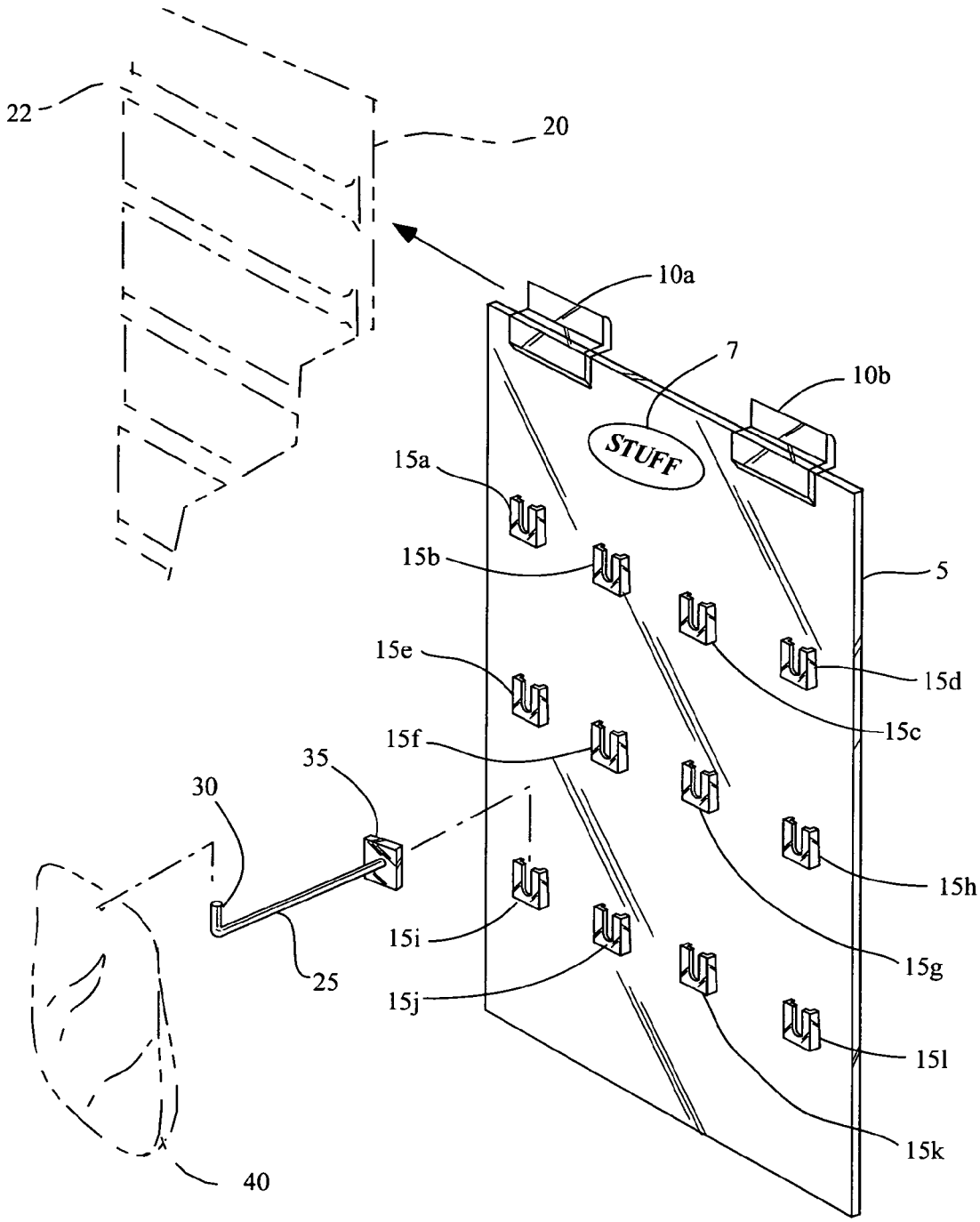
FIG. 4—depicts a first perspective view of the invention.

Referring to FIG. 4, a first installation embodiment is depicted where the display board 5 is slidably mounted in a slot 22 of the slot wall 20. In this exemplary embodiment of the invention, the upper portions of the brackets 10*a*, 10*b* are slid laterally into the channel forming the slot 22, moved into a desired location on the slot wall 20 and released. Merchandise item(s) 40 may be pre-positioned on the support arm(s) 25 before installing the display board 5 on the slot wall 20 or thereafter.

The support arm(s) 25 are installed by aligning the connector 35 portion of the support arm 25 with the slot at the top of the raised frame 15*i* with the hook end 30 of the support arm 25 facing up. The support arm 25 is slid vertically downward which allows the connector portion 35 of the support arm 25 to engage the raised frame 15*i*, forming a type of cantilever arm.

The merchandise item(s) 40 are then disposed on the support arm(s) 25 by threading the hook end 30 through an aperture provided in the packaging of the merchandise item(s) 40.

Figure 5:
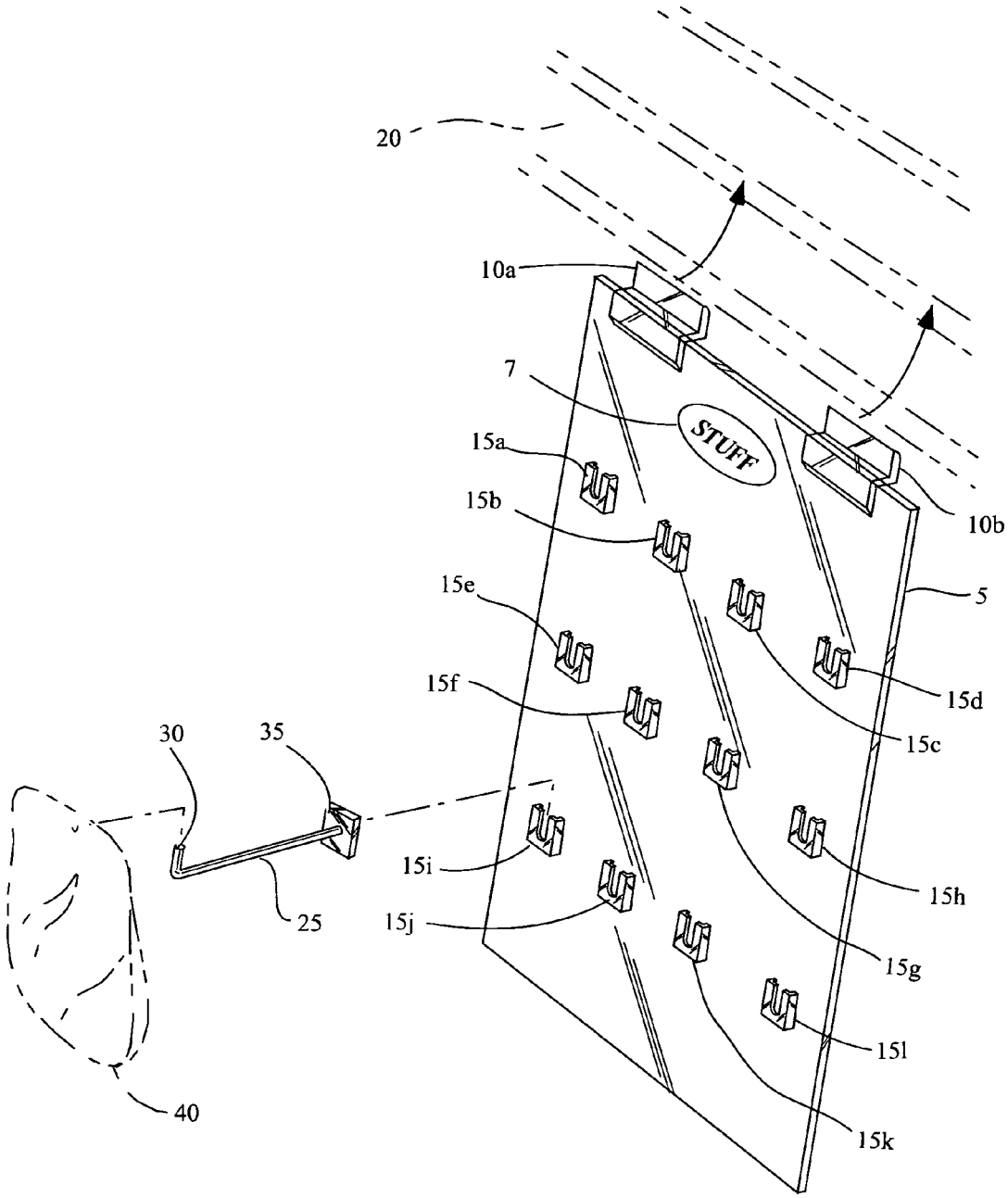
FIG. 5—depicts a second perspective view of the invention.

Referring to FIG. 5, a second installation embodiment is depicted where the display board 5 is tilted or aligned tangentially to the intended slot 22 of the slot wall 20.

In this depicted embodiment of the invention, the upper portions of the brackets 10*a*, 10*b* are inserted at angle into the channel forming the slot 22 and generally at the desired location on the slot wall 20. As before, the merchandise item(s) 40 may be pre-positioned on the support arm(s) 25 before installing the display board 5 on the slot wall 20 or thereafter.

Figure 6:
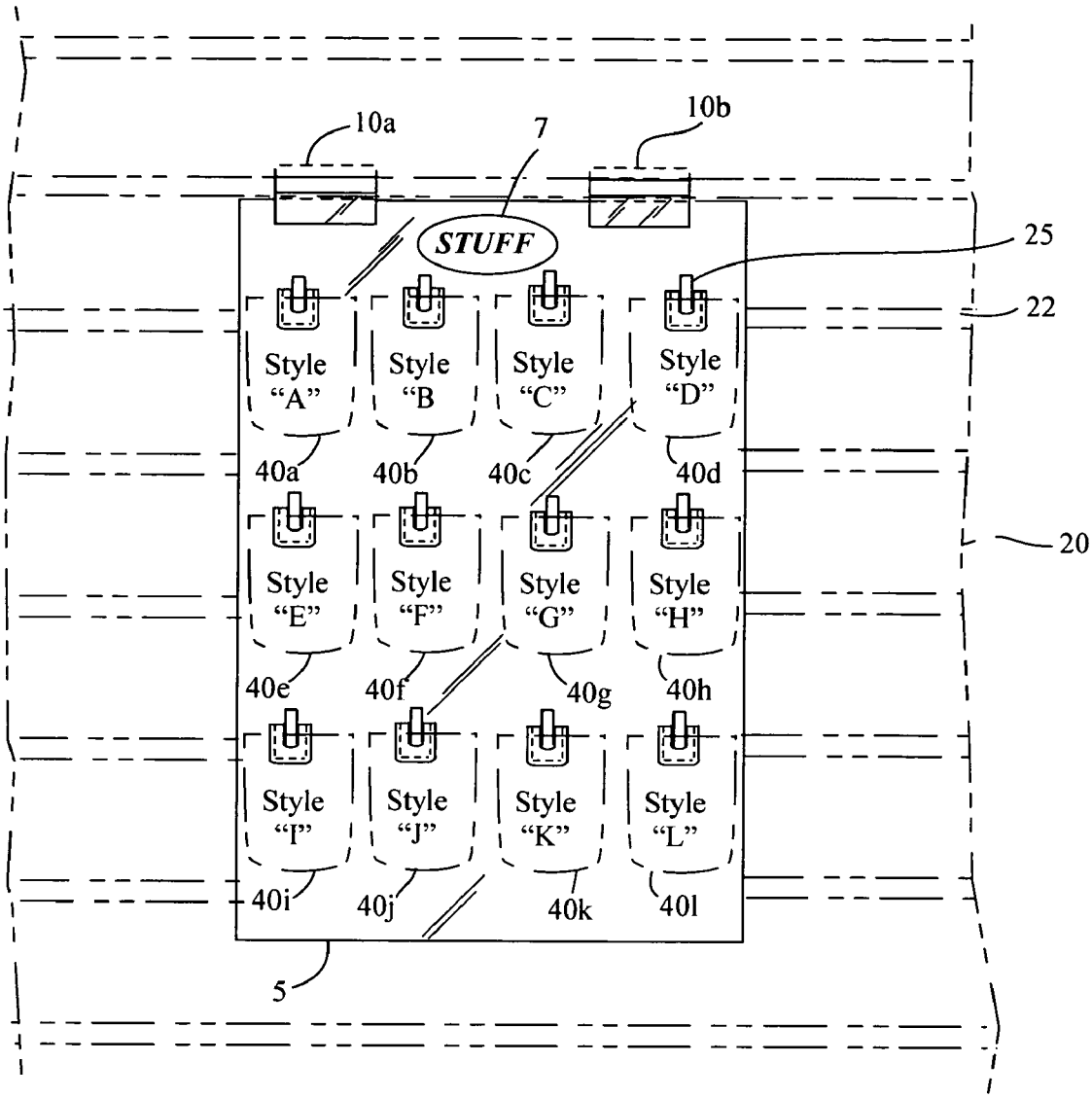
FIG. 6—depicts a frontal view of the invention with a merchandising arrangement.

Referring to FIG. 6, a completed merchandising display system is depicted where a plurality of related or complementary merchandise items 40*a*-40*l* are displayed on a display panel 5. The display panel 5 is installed in a selected slot 22 of a slot wall 20 at a desired location.

In this exemplary embodiment of the invention, different styles of a related or complementary type of merchandise (Styles A-L) 40*a*-40*l* are displayed in an organized and easily maintainable merchandising display system. The completed display system has many advantages including but not limited to; optimized use of limited slot wall space, simplification in re-ordering and restocking of the merchandise, improved aesthetics, improved organization of the displayed merchandise, simplified standardization for displaying of the merchandise, minimized time and labor required for setup, maintenance and replacement of a display, and facilitates the use of pre-assembled or easily assembled for display kits for a slot wall.

Figure 7:
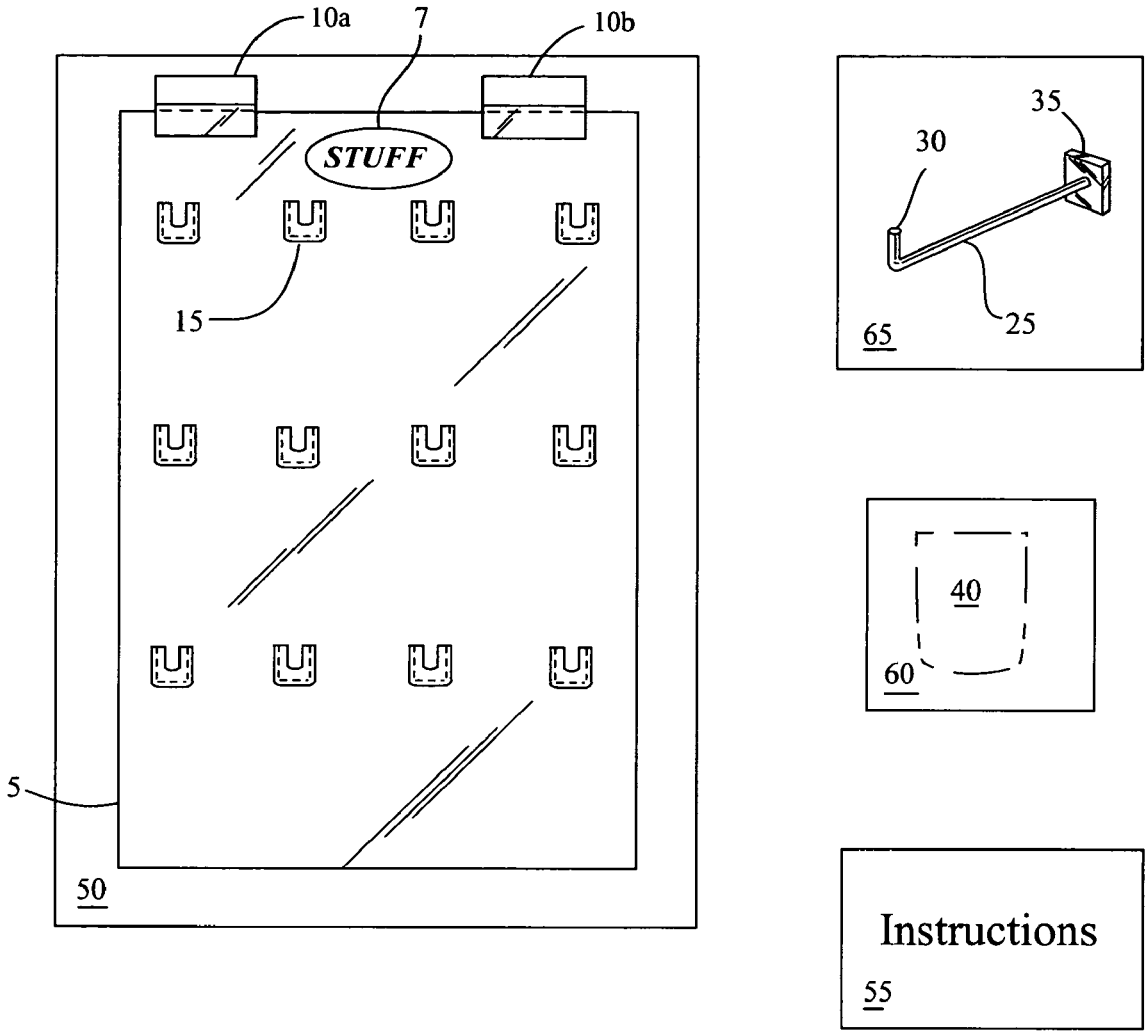
FIG. 7—depicts a first kit form embodiment of the invention.

Referring to FIG. 7, a first embodiment of a kit form of the invention is depicted. In this exemplary embodiment of the invention, the display panel 5 merchandise 40, support arms 25, and instructions 55 for assembling and displaying the merchandise are provided in packaging 50, 60, 65 and sent to a retail establishment or merchandiser for assembly and installation on a slot wall.

The instructions 55 are intended to provide sufficient information to properly assembly the display system, including merchandise 40 placement on the display board 5.

Figure 8:
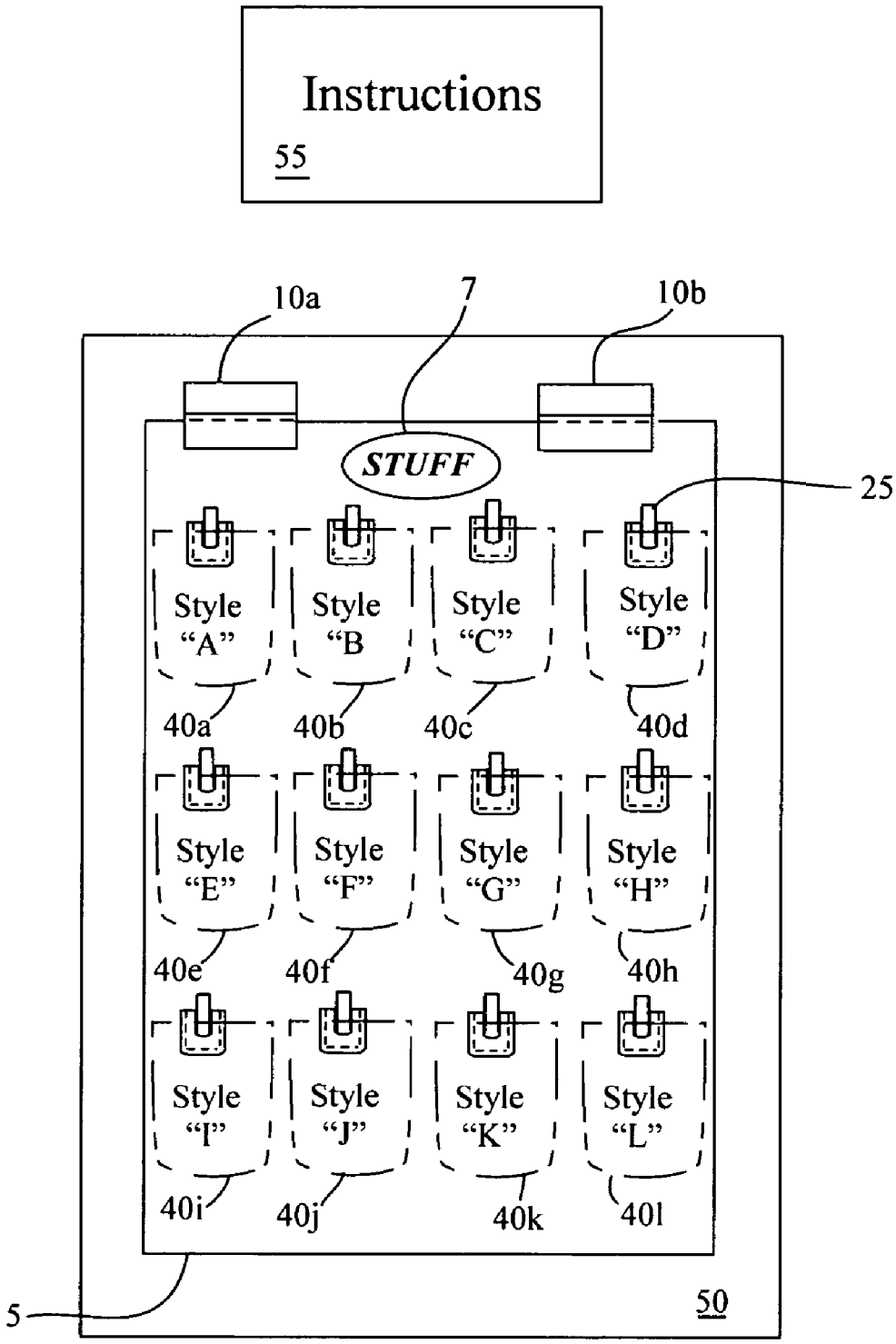
FIG. 8—depicts a second kit form embodiment of the invention.

Referring to FIG. 8, a second embodiment of the kit form of the invention is depicted. In this exemplary embodiment of the invention, the display panel 5, support arms 25, and merchandise 40 are prepackaged 50 by a distributor or other third party provider and sent to the retail establishment or merchandiser with placement instructions 55 for displaying the on a slot wall.

The foregoing described embodiments of the invention are provided as illustrations and descriptions. They are not intended to limit the invention to precise form described. In particular, it is contemplated that various dimensions, colors and construction materials of the invention described herein may be implemented. No specific limitation is intended to a particular dimension, shape or construction material.

What is claimed:

1. A merchandising system comprising:

a display panel dimensioned to cover at least a portion of a display wall including;

coupling means for slidably coupling a plurality of support arms onto a front surface of said display panel, said coupling means comprising a plurality of raised frames affixed onto said front surface of said display panel;

interfacing means for interfacing said display panel to said display wall, and, a plurality of support arms, each of said plurality of support arms perpendicularly coupled onto said front surface using said coupling means and to slidably maintain a plurality of related or complementary merchandise items suspended therefrom;

wherein said merchandising system forms an easily maintainable sub panel when said plurality of related or complementary merchandise items are suspended from said plurality of support arms and said display panel is interfaced to said display wall; and, wherein said plurality of raised frames affixed to said front surface of said display panel form receptacles slidably coupling said plurality of support arms directly onto said front surface of said display panel, such that a rear surface of each of said support arms is directly adjacent to said display panel.

2. The system according to claim 1 wherein said display panel comprises a lightweight polymeric construction.

3. The system according to claim 1 wherein said interfacing means comprises at least one bracket coupled to at least portion of a top edge of said display panel.

4. The system according to claim 1 further including indicia of said related or complementary merchandise affixed to said display panel.

5. The system according to claim 4 wherein said indicia consists essentially of an adhesive label.

6. A merchandising system comprising:

a display panel dimensioned to cover at least a portion of a display wall including;

a front surface having affixed thereupon a plurality of raised frames, each of said plurality of raised frames being adapted to perpendicularly receive a support arm of sufficient structural integrity to slidably maintain at least one item of merchandise suspended therefrom;

at least one bracket coupled to at least a portion of a top edge of the display panel and said at least one bracket dimensioned to engage an opening provided in said display wall and configured to maintain said display panel in a generally parallel orientation to said display wall when said at least one item of merchandise is displayed thereon; and, a plurality of support arms, each of said plurality of support arms slidably coupled to each of said plurality of raised frames;

wherein said plurality of raised frames affixed to said front surface of said display panel form receptacles slidably coupling said plurality of support arms directly onto said front surface of said display panel, such that a rear surface of each of said support arms is directly adjacent to said display panel.

7. The system according to claim 6 wherein said display panel comprises a lightweight polymeric construction.

8. The system according to claim 6 wherein said at least one bracket comprises a rearward facing element coupled to said at least a portion of said top edge in a generally perpendicular orientation to said front surface, such that said rearward facing element fits into said opening and engages an interior surface of said display wall.

9. The system according to claim 6 wherein said support arm engages at least one of said plurality of raised frames at a generally right angle to said front surface.

10. The system according to claim 6 wherein each said support arm comprises;

a longitudinal element;

a connector disposed at one end of said longitudinal element and securely coupling said support arm to at least one plurality of raised frames; and, a hook at an opposite end from said connector and adapted to maintain said at least one item of merchandise on said support arm under generally static conditions.

11. The merchandising system according to claim 6 wherein said at least one bracket engages said opening.

12. The merchandising system according to claim 6 wherein said at least one bracket tangentially engages said opening.

13. A method of merchandising items comprising:

obtaining a display panel dimensioned to cover at least a portion of a display, said display panel being adapted to interface with said display wall and including a plurality of raised frames affixed onto a front surface of said display panel;

slidably coupling a plurality of support arms onto said front surface of said display panel in an arrangement such that merchandisable items are slidably maintained on said plurality of support arms without causing visual obstruction in a field of view generally perpendicular to said front surface, placing generally complementary subsets of said merchandisable items onto said plurality of support arms such that each of said plurality of support arms with said complementary subsets of said merchandisable items forms a repositionable grouping of complementary merchandisable items, and mounting said display panel having said placed grouping of complementary merchandisable items onto said display wall;

wherein said plurality of raised frames affixed to said front surface of said display panel form receptacles slidably coupling said plurality of support arms directly onto said front surface of said display panel, such that a rear surface of each of said support arms is directly adjacent to said display panel.

14. The method according to claim 13 further including optimizing said placed grouping to meet sales demand.

15. The method according to claim 14 wherein said mounting comprises tangentially disposing said display panel in an opening associated with said display wall.

16. The method according to claim 13 wherein said mounting comprises slidably disposing said display panel in an opening associated with said display wall.

17. A method of merchandising items which incorporates a display panel dimensioned to cover at least a portion of a display wall, said display panel including a front surface having a plurality of raised frames affixed to said front surfaces for perpendicularly receiving a plurality of support arms, at least one bracket coupled to at least a portion of a top edge of the display panel and said at least one bracket dimensioned to engage an opening provided in said display wall and configured to maintain said display panel in a generally parallel orientation to said display wall when said at least one item of merchandise is displayed thereon and a plurality of support arms coupled to said plurality of receptacles; said method of merchandising items comprising:

slidably coupling at least a portion of said plurality of support arms to at least a portion of said plurality of raised frames in an arrangement such that merchandisable items are slidably maintained on each of said plurality of support arms without causing visual obstruction in a field of view generally perpendicular to said front surface, placing generally complementary subsets of said merchandisable items onto said plurality of support arms such that said display panel forms a repositionable grouping of complementary merchandisable items among said plurality of raised frames, and mounting said display panel having said placed grouping of complementary merchandisable items onto said display wall;

wherein said plurality of raised frames affixed to said front surface of said display panel form receptacles slidably coupling said plurality of support arms directly onto said front surface of said display panel, such that a rear surface of each of said support arms is directly adjacent to said display panel.

18. The method according to claim 17 further including optimizing said placed grouping to meet sales demand.

19. The method according to claim 17 wherein said mounting of said display panel comprises engaging said at least one bracket into said opening and disposing said at least one bracket therein.

20. The method according to claim 17 wherein said mounting of said display panel comprises tilting said display panel at an angle to display wall, inserting said at least one bracket into said opening and allowing said display panel to pivot to a generally parallel orientation to said display wall.

21. A merchandising display system comprising:

a display panel dimensioned to cover at least a portion of a display wall including;

a front surface having affixed thereupon a plurality of raised frames, each of said plurality of raised frames being adapted to perpendicularly receive a support arm of sufficient structural integrity to slidably maintain at least one item of merchandise suspended therefrom;

at least one bracket coupled to at least a portion of a top edge of the display panel and said at least one bracket dimensioned to engage an opening provided in said display wall and configured to maintain said display panel in a generally parallel orientation to said display wall when said at least one item of merchandise is displayed thereon;

a plurality of support arms, each of said plurality of support arms being slidably coupled to said plurality of raised frames;

said at least one item of merchandise; and, written instructions for at least displaying said at least one item of merchandise from said display panel;

wherein said plurality of raised frames affixed to said front surface of said display panel form receptacles slidably coupling said plurality of support arms directly onto said front surface of said display panel, such that a rear surface of each of said support arms is directly adjacent to said display panel.

22. The system according to claim 21 wherein said display panel having said at least one bracket coupled thereto, said plurality of support arms, said at least one item of merchandise and said written instructions comprises a kit arranged for distribution to at least one merchandiser.

23. The system according to claim 22 wherein said kit is distributed to said at least one merchandiser unassembled.

24. The system according to claim 22 wherein said kit is distributed to said at least one merchandiser assembled.

* * * * *